US010657744B2

(12) United States Patent
Ruggieri et al.

(10) Patent No.: US 10,657,744 B2
(45) Date of Patent: May 19, 2020

(54) ACCESS CONTROL SYSTEM AND METHOD USING ULTRASONIC TECHNOLOGY

(71) Applicant: Schlage Lock Company LLC, Carmel, IN (US)

(72) Inventors: Manuel Ruggieri, Trossingen (DE); Frank Maurer, Aldingen (DE)

(73) Assignee: Schlage Lock Company LLC, Carmel, IN (US)

( * ) Notice: Subject to any disclaimer, the term of this patent is extended or adjusted under 35 U.S.C. 154(b) by 0 days.

(21) Appl. No.: 16/345,906

(22) PCT Filed: Oct. 30, 2017

(86) PCT No.: PCT/US2017/059014

§ 371 (c)(1),
(2) Date: Apr. 29, 2019

(87) PCT Pub. No.: WO2018/081697

PCT Pub. Date: May 3, 2018

(65) Prior Publication Data

US 2019/0266822 A1 Aug. 29, 2019

Related U.S. Application Data

(60) Provisional application No. 62/414,514, filed on Oct. 28, 2016.

(51) Int. Cl.
*G07C 9/00* (2020.01)

(52) U.S. Cl.
CPC ..... *G07C 9/00309* (2013.01); *G07C 9/00* (2013.01); *G07C 9/00571* (2013.01); *G07C 2009/00801* (2013.01); *G07C 2209/63* (2013.01)

(58) Field of Classification Search
CPC ..... G07C 9/00309; G07C 9/00571; G07C 2009/00801
USPC ..... 340/5.64
See application file for complete search history.

(56) References Cited

U.S. PATENT DOCUMENTS

| | | | | |
|---|---|---|---|---|
| 9,264,151 | B1 * | 2/2016 | Emigh | G06Q 30/0211 |
| 2011/0029370 | A1 | 2/2011 | Roeding et al. | |
| 2014/0068751 | A1 * | 3/2014 | Last | G06F 21/35 726/16 |
| 2015/0350405 | A1 | 12/2015 | Rettig et al. | |
| 2016/0066254 | A1 * | 3/2016 | Colby | H04W 4/026 455/41.1 |

(Continued)

OTHER PUBLICATIONS

International Search Report; ISA/US Commissioner for Patents; International Application No. PCT/US2017/059015; dated Jan. 26, 2018; 2 pages.

(Continued)

*Primary Examiner* — Vernal U Brown
(74) *Attorney, Agent, or Firm* — Taft Stettinius & Hollister LLP

(57) ABSTRACT

A system including a reader device and a mobile device having a user credential. The reader device includes an ultrasonic transmitter configured to transmit an identifier, and a wireless transceiver configured to receive information from and transmit information to the mobile device. The identifier is configured to be received by a microphone of the mobile device. The mobile device may determine a position of the mobile device based on the identifier.

20 Claims, 5 Drawing Sheets

(56) References Cited

U.S. PATENT DOCUMENTS

2016/0189454 A1 6/2016 Johnson et al.
2016/0343185 A1* 11/2016 Dumas ..... G07C 9/00309

OTHER PUBLICATIONS

Written Opinion of the International Searching Authority; ISA/US Commissioner for Patents; International Application No. PCT/US2017/059015; dated Jan. 26, 2018; 6 pages.

* cited by examiner

ACCESS CONTROL SYSTEM AND METHOD USING ULTRASONIC TECHNOLOGY

CROSS REFERENCE TO RELATED APPLICATIONS

This application claims the benefit of U.S. Provisional Application Ser. No. 62/414,514 filed Oct. 28, 2016, the contents of which are incorporate herein by reference in their entirety.

FIELD OF THE DISCLOSURE

The present disclosure generally relates to an access control system and method, and more particularly, but not exclusively, relates an access control system and method that uses ultrasonic technology to communicate between an access control device and a mobile device.

BACKGROUND

Existing access control systems are used to control access to various areas, devices or data. Some systems utilize wireless electronic locks that communicate with an interface device, also known as a panel interface module, located sufficiently proximate to the electronic locks to enable radio communication. The interface device is configured to monitor and control the state of a predetermined number of electronic locks. Multiple interface devices can be required in a facility of a large size since one interface device may be insufficient to monitor and control all of the electronic locks in the facility. Consequently, a number of interface devices may be hardwired or wirelessly connected to a central controller, also known as an access control panel, and are interconnected with the computer system of the facility. In some facilities, more than one access control panel may be required, and the computer system may provide updates to the electronic locks through the radio communication network or wired between the interface device and the electronic locks.

Some existing systems, when used inside of a building or other structure, are susceptible to multi-path interference from door and hall passages, individuals, and architectural construction which may limit the effective range of communication between the interface device and the electronic lock, each of which includes a transceiver. The electronic lock also includes a credential reader (e.g., a near field communication (NFC) reader) which is configured to read a user credential. The user credential may include, in various embodiments, an access card, a key fob, and a mobile device such as, for example, a smart phone. In one embodiment, a communication protocol known as Bluetooth is used to provide communication between the credential reader and the credential. As used herein, the term Bluetooth includes Bluetooth Low Energy (BLE) technology, which is also referred to as Bluetooth Smart or version 4.0+. Bluetooth uses a technique known as spread-spectrum frequency hopping to randomly switch frequency channels when a selected channel is already in use.

Present credential readers may suffer from a variety of limitations, including high power consumption, reduced credential detection range, and a high false credential detection rate. When using a mobile device having a Bluetooth credential, it is not always possible when a reader recognizes a credential: 1) for a user to clearly identify which credential reader of many credential readers is attempting to make an identification; 2) which mobile device is providing the credential; and 3) a physical location of a user using the mobile device with respect to a credential reader. This result typically occurs due to design of the antenna. This may prevent an accurate position detection and automatic access control of the correct door lock which recognizes a mobile device with a Bluetooth credential.

When using a Bluetooth enabled credential in an environment with multiple doors and/or access control points, there is a need for improved user interaction. In some instances, because the range detection of the Bluetooth communication is often inexact, an automatic opening of any door in Bluetooth range can occur, which leads to a lack of security. What is therefore needed is a communication technology and protocol between the credential reader and the mobile device which provides for greater precision in the opening and/or closing of doors and/or access control points.

SUMMARY

One embodiment of the present disclosure is directed to a unique access control system and method that uses ultrasonic technology and other wireless technology to communicate between an access control device and a mobile device. Other embodiments include apparatuses, systems, devices, hardware, methods, and combinations for sending and receiving access control communications. Further embodiments, forms, features, aspects, benefits, and advantages of the present disclosure shall become apparent from the description and figures provided herewith.

BRIEF DESCRIPTION OF THE DRAWINGS

The description herein makes reference to the accompanying figures wherein like reference numerals refer to like parts throughout the several views, and wherein.

DETAILED DESCRIPTION

Figure 1:
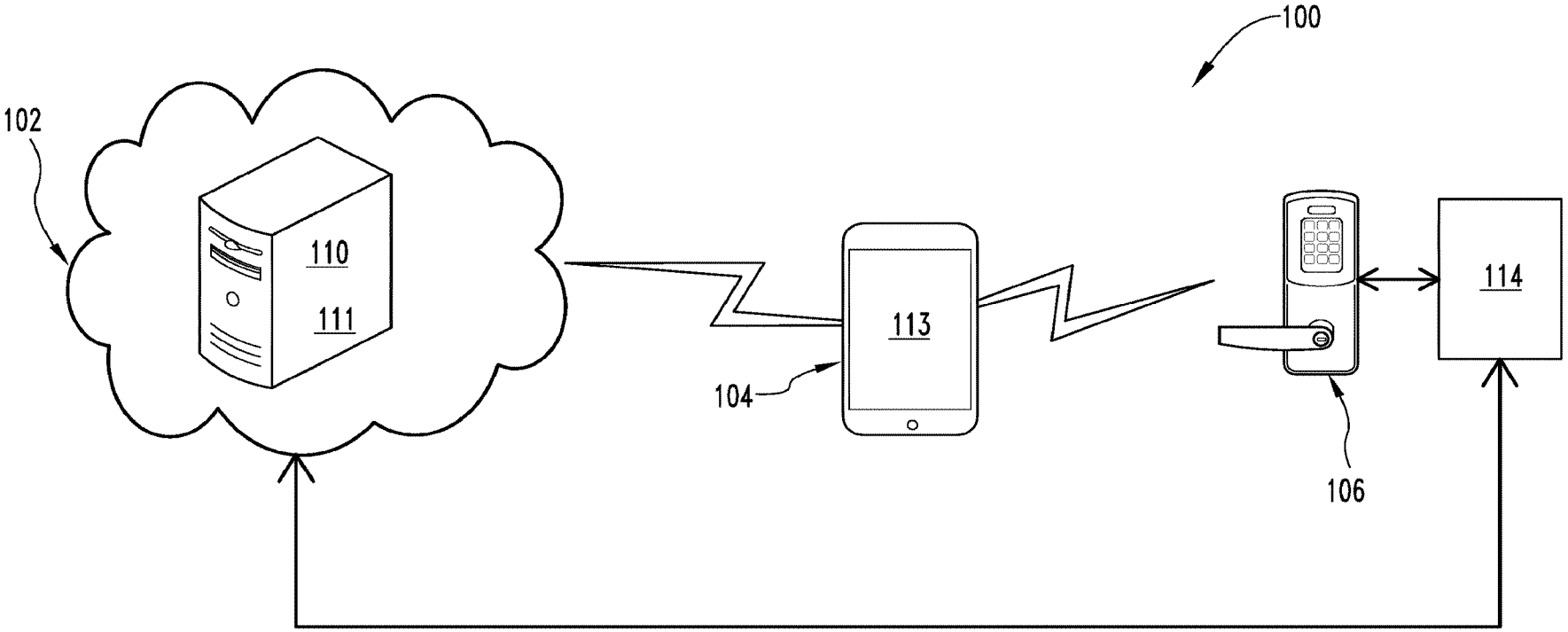
FIG. 1 is a schematic block diagram of an exemplary access control system.

For the purposes of promoting an understanding of the principles of the invention, reference will now be made to the embodiments illustrated in the drawings and specific language will be used to describe the same. It will nevertheless be understood that no limitation on the scope of the invention is hereby intended. Any alterations and further modifications in the described embodiments, and any further applications of the principles of the invention as described herein are contemplated as would normally occur to one skilled in the art to which the invention relates.

FIG. 1 illustrates an exemplary access control system 100. In one embodiment, the access control system 100 is used in association with one or more reader devices that may include electronic locks. However, it is contemplated that, in other embodiments, the system 100 may be used in association with a payment system (e.g., to authorize a payment), a transit system (e.g., to purchase entry onto the transit system), an alarm system (e.g., to deactivate the alarm system), or any other system that utilizes a credential or a unique identifier.

In the illustrated embodiment, the system 100 includes a server 102, a mobile device 104, a reader device 106 and, in some embodiments, an access control panel or controller 114. In a further embodiment, the reader device 106 includes a Bluetooth element or device 107 including a Bluetooth transceiver, and an ultrasonic transmitter 109 (FIGS. 2 and 3).

In one embodiment, the server 102 provides a credential management service which, in the illustrated embodiment, may include a cloud application 110. The credential management service, via the cloud application 110, generally maintains and hosts a database 111 of user configuration information, credentials, statuses, device configurations for user interfaces, updates, key management, credential management, tracking, notifications, access control information, alarm information and/or audit history information for assets. It is contemplated that the type of data stored in the database 111, in various embodiments, depends on the type of system (e.g., access control system, payment system, transit system, etc.). Additionally, the server 102 may include multiple servers, and in various embodiments communicates with the mobile device 104 and/or the access control panel or controller 114 via an Internet connection. In still other embodiments, a cloud system need not necessarily be incorporated into the system 100.

As illustrated in FIG. 1, the mobile device 104 may be configured as a mobile phone such as, for example, a cell phone or a smartphone. In other embodiments, the mobile device 104 may be configured as a tablet computer, a smartcard, or any other mobile computing device that can store data and communicate with the reader device 106. In the embodiment shown in FIG. 1, the reader device 106 is provided as a wireless electronic lock configured to communicate with the mobile device 104 and the server 102 (via the mobile device 104 or via the access control panel or controller 114). However, it is contemplated that in other embodiments, the reader device 106 may be provided as other types of devices configured to receive and/or process credential information or a unique identifier. Other types of suitable reader devices 106 are also contemplated as would occur to those skilled in the art. FIGS. 2 and 3 specifically discuss the reader device as an electronic lock 106.

Figure 2:
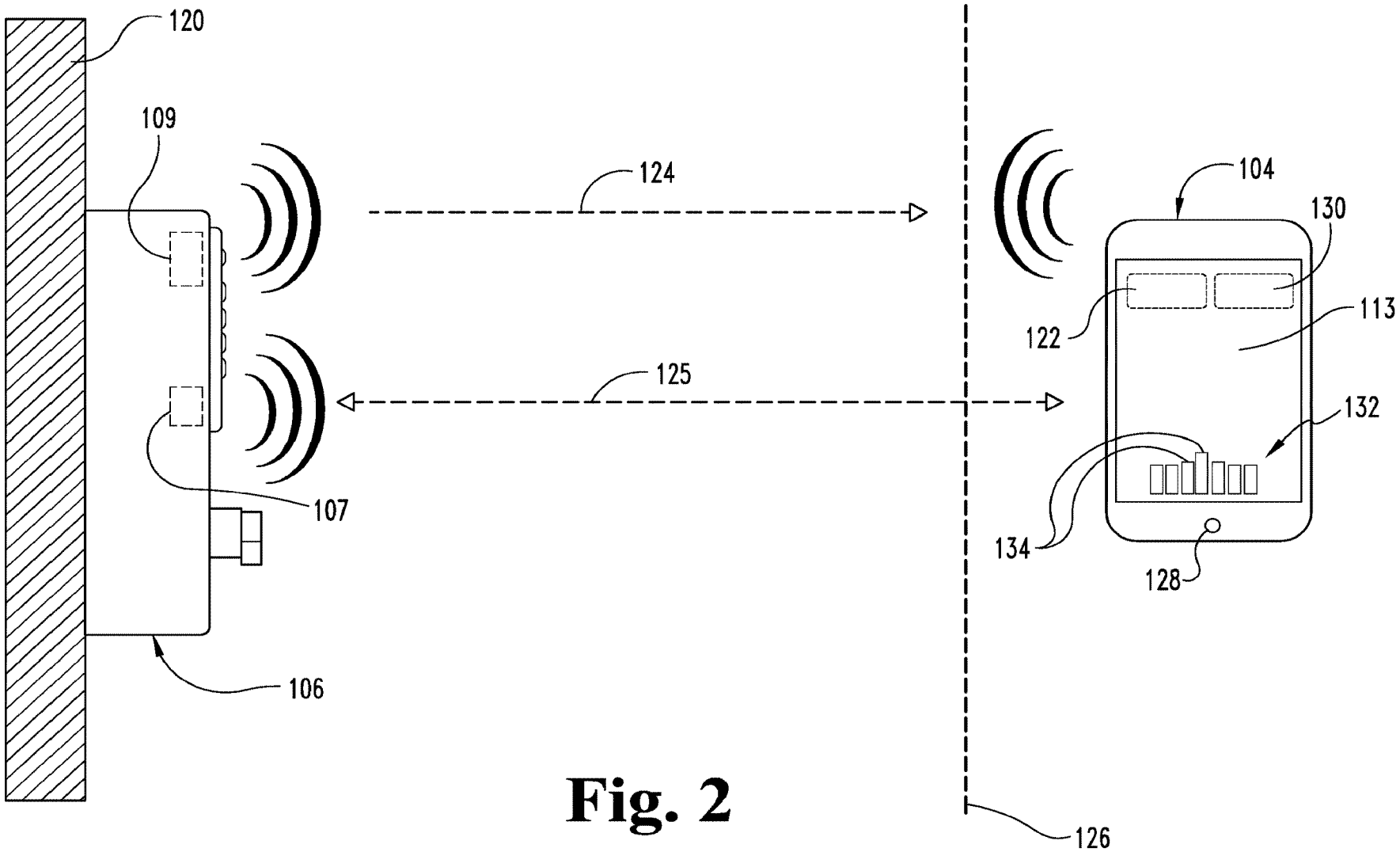
FIG. 2 is a schematic diagram of an exemplary access control device transmitting a first and second signal to a mobile device having a credential.
Figure 3:
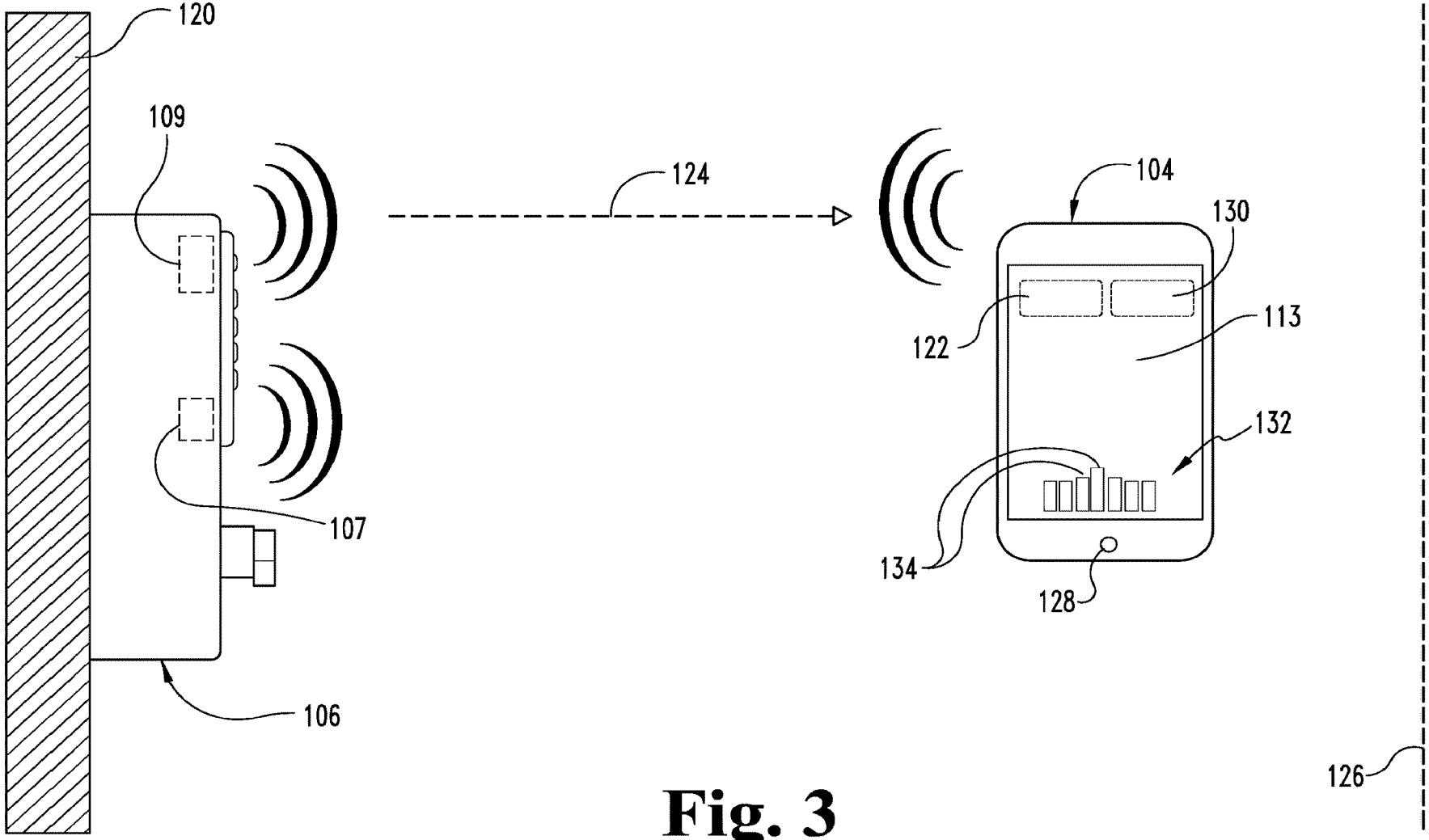
FIG. 3 is a schematic diagram of an exemplary access control device in communication with a mobile device having a credential.

Referring collectively to FIGS. 1-3, the electronic lock 106 includes a Bluetooth transceiver 107 configured to communicate with a Bluetooth transceiver 122 associated with the mobile device 104. In some embodiments, one or both of the transceivers are configured as a receiver and a transmitter. As used herein, the term Bluetooth includes Bluetooth Low Energy (BLE), also known as Bluetooth Smart. It is contemplated that the mobile device 104 and the reader device 106 may communicate via a protocol other than Bluetooth such as, for example, short wavelength transmission such as near field communication (NFC), or any other appropriate communication protocol such as WiFi. The mobile device 104 also includes software and/or hardware to provide the mobile phone 104 with the capability to communicate with the server 102 over the Internet.

In one embodiment, a user generates user interface configurations for the reader device 106 by utilizing an application 113 on the mobile device 104. Additionally or alternatively, the user interface configurations are selected and downloaded by the mobile device 104 from the server 102 via, for example, the cloud application 110 The mobile device 104 may communicate or transmit the user interface configurations to the reader device 106 based on selections made by the user. The reader device 106 may also include software and/or hardware to receive and implement the user interface configurations from the mobile device 104.

The mobile device 104 supports the use of one or more applications 113 (also known as an "app") which communicate with the reader 106 as well as the server 102. The apps are stand-alone software applications which run on the user's mobile device 104. The application(s) described herein can be embodied as program code in software and/or firmware resident in one or more one or more of the illustrated devices, in the user interface of a mobile device, or in remote devices which are coupled to the system 100 through hardwired connections, wireless connection, connections to the Internet, or other means of communication to software or firmware that may be wired and/or wireless.

The configuration of the user interface (UI) of the mobile device 104 may be personalized by the individual user, as well as being set to a common, population-wide set of characteristics. A user may personalize the UI through a combination of server 102 and/or mobile device 104 based services. Moreover, a credential user may also personalize their experience with a reader device 106, while maintaining and/or adhering to the system administration rules and security. Additionally, an administrator of the system 100 may also be able to uniquely customize the UI of the reader devices 106.

The mobile device 104 is configured to determine when to store information, send information to the server 102, and/or send information to the reader device of the electronic lock 106. This function may be used to optimize data transfer for a frequently connected electronic lock 106, and may also be used to store and forward information to the electronic lock 106 which are connected infrequently and/or outside the range of a "real-time" or frequent data connection to the server 102.

FIGS. 2 and 3 further illustrate the electronic lock 106 as having a reader device in communication with a mobile device 104, which is illustrated as a mobile phone having an advanced mobile operation system configured to provide features of a personal computer, generally known as a "smartphone". The electronic lock 106 is coupled to a door or other access control structure 120, the details of which are known to those skilled in the art. The credential reader of the electronic reader/lock 106 includes the Bluetooth transceiver 107 which is configured to communicate with the Bluetooth transceiver 122 of the mobile device 104, the details of which are also known by those skilled in the art. In other embodiments, the transceivers 107 and 122 include other near field communication (NFC) protocols.

In the illustrated embodiment, the reader/lock 106 also includes an ultrasonic transducer 109 which is configured to transmit an ultrasonic signal including a unique dataset using an ultrasonic communication protocol. At the signal strengths being transmitted, the ultrasonic signal is generally considered to be a line-of sight signal. Ultrasonic signals generally include frequencies above 20 kilohertz (kHz). However, in other embodiments, ultrasonic signals may be as low as 16 kHz. In another embodiment, the transmitter 109 transmits an ultrasonic signal along a signal path 124 (FIG. 2) directed to the mobile device 104 when the mobile device 104 is within range of the ultrasonic transmitter 109.

When the mobile device 104 is within a reception range of the transmitter 109, here indicated as a distance threshold 126, a microphone 128 of the mobile device 104 is adapted to receive the ultrasonic signal. Additionally, a signal path 125 for a Bluetooth signal transmitted by the Bluetooth transceiver 107 illustrates that the distance for communication between the Bluetooth transceiver and the mobile device may be greater than the distance for communication between the ultrasonic transmitter 109 and the microphone 128.

In one embodiment, the microphone 128 is configured as a standard microphone that is typically included with mobile devices or smartphones, and has a frequency sensitivity range of generally at or above 20 kHz. In other embodiments, different types of microphones may be provided which have frequency ranges of greater than 20 kHz, for example. In still other embodiments, the smartphone may include a standard microphone as well as a higher frequency microphone. In the event that the access control system 100 is configured to operate with mobile devices having microphones with higher frequency capabilities, the transmitter 109 may be configured to generate correspondingly higher ultrasonic frequencies to be received by the higher frequency capable microphone 128.

The mobile device 104 may further include a separate ultrasonic receiver 130 operatively connected to the microphone 128 to receive the ultrasonic signal transmitted by the ultrasonic transmitter 109 of the electronic reader/lock 106. In some embodiments the ultrasonic signal is modulated by the ultrasonic transmitter 109 and demodulated by the ultrasonic receiver 130. In other embodiments, the microphone 128 demodulates the ultrasonic signal if the ultrasonic signal is modulated.

The transmitter 109 of the reader/lock 106 transmits data having a predetermined data protocol with the ultrasonic signal. In one embodiment, different frequencies generally at or above 20 kHz are used to identify the reader/lock 106 from a plurality of other readers/locks located in a facility, and to transmit the identity information or data to the mobile device 104. For instance, if a facility has thirty different readers/locks, thirty different frequencies near or above 20 kHz may be used to identify and distinguish each of individual reader/lock. In another embodiment, each of the readers/locks is identified by a byte of digital information of a predetermined length, where each of the digits is a one or a zero distinguished by two different frequencies. The group of digits within a byte identifies which of the plurality of readers/locks transmits the signal.

By transmission of an ultrasonic signal incorporating an identifier, such as a dataset or data protocol to identify the reader/lock, the system also provides an indication of a user's location with respect to a reader/lock using a mobile device credential on the mobile device 104. The reader/lock 106 transmits the ultrasonic signal and the Bluetooth signal, both of which include a unique dataset specific to the reader/lock. The dataset of both the ultrasonic signal and the Bluetooth signal is used as a two-way identification between the reader/lock 106 and the mobile device 104. Additionally, the ultrasonic signal is used to evaluate the proximity or position of the user by measuring the amplitude of the ultrasonic signal received at the mobile device 104. When the user is in a defined proximity, position, and/or area with respect to a nearby reader/lock 106, as determined by receipt of the ultrasonic signal by the mobile device 104, the identifying credential is transmitted via the Bluetooth signal of the mobile device 104 to the reader/lock 106. This credential includes a unique identifier that is used by the reader/lock or the access control panel or controller to determine whether access is granted or denied.

As shown in FIG. 2, the distance threshold 126 illustrates that the ultrasonic signal being transmitted by the reader/lock 106 is capable of identifying a proximate reader to a user and may be used to determine an intent of a user wishing to access an area secured by the reader device 106. When using a Bluetooth credential, it is not always possible to clearly identify a reader to a mobile device, and to also detect the position of the user, when using only a Bluetooth signal. This is due to the wide antenna range and the circular antenna radiation design used in many Bluetooth antennas. In addition, because the Bluetooth signal is transmitted in the GHz range, the signal is reflected as well as being transmitted through walls and other obstructions. By transmitting an ultrasonic signal to a user, the location of the reader/lock 106 can be more clearly identified to a mobile device of a user (as illustrated in FIG. 2) before or after identifying the credential of the user to the reader/lock 106. Identification of the mobile device to the reader/lock 106 is further illustrated and described with respect to FIG. 3.

The application 113 of the mobile device 104 may monitor the ultrasonic signal received from the electronic reader/lock 106 to determine a user's intent with respect to which door to unlock. The mobile device 104 may receive more than one ultrasonic signal or a continuous ultrasonic signal that the mobile device 104 uses determine or evaluate the mobile device's position relative to the reader/lock 106. For example, if the mobile device 104 determines that the user is moving the mobile device 104 closer and closer to the reader/lock 104, the mobile device 104 may conclude that the user intends to enter the door associated with the reader/lock 106. In this example, the mobile device 104 may then transmit the credential to the reader/lock 106, or send an unlock command to the reader/lock 106 if the credential the credential was previously sent, so that the reader/lock 106 unlocks. Furthermore, the ultrasonic signal typically will not penetrate a door so the issue of determining which side of the door a user is located is achieved by the nature of reader.

It is contemplated that in some embodiments that the first communication between the mobile device 104 and the electronic reader/lock 106 is the Bluetooth communication which the mobile device 104 requests the reader/lock 106 to transmit an ultrasonic signal to the mobile device 104. Furthermore, the mobile device 104 may request the reader/lock 106 to transmit a particular or unique ultrasonic signal that the mobile device 104 may receive and track to evaluate the mobile device's proximity or position relative to the reader/lock 106. As an example, the mobile device 104 may transmit an identifier to the reader device 106 via Bluetooth. The reader device 106 may then begin transmitting an ultrasonic signal with that identifier so that the mobile device 104 receives and uses to determine the proximity to the reader device 106. The identifier may be a unique number or the identifier may be a unique modulation pattern. In other embodiments, the identifier may be randomly generated by the reader device 106.

It is further contemplated that the reader device 106 may begin transmitting the ultrasonic signal once the reader device 106 determines a mobile device 104 is within a certain proximity based on the signal strength of the Bluetooth signals from the mobile device 104.

As indicated above, the mobile device 104 may include an application 113 displayed on a user interface 132. In one embodiment, a signal strength of each one of the ultrasonic signals transmitted by a plurality of readers 106 may be indicated by one of a plurality of vertical bars 134 on the user interface 132 in the application 113. In another embodiment, the height of each of the vertical bars may illustrate which of the readers/locks 106 is closest to the user. In addition, each of the vertical bars 134 may include additional information relating to the location of a particular door to which the reader/lock 106 is attached. In a further embodiment, the information is displayed with each of the vertical bars 134. In another embodiment, selection of a vertical bar 134 provides additional information regarding the selected reader/lock as well as the door. For instance, in various embodiments, directions to the selected door and/or the status of the door (i.e., whether the door is open or closed, locked or unlocked) may be displayed on the user interface 132. In still other embodiments, a status selector may be displayed to provide an option of selecting the status of a particular electronic reader/lock.

Once the door is selected or confirmed by the mobile device or the user, the Bluetooth transceiver 122 identifies the user to the electronic reader/lock 106 along the path 125 illustrated in FIG. 3 by transmitting the credential to the reader/lock 106. At this point, Bluetooth signal transmission along the signal path 125 is bi-directional. If the user is authorized, the door is automatically unlocked or automatically opened depending on a predetermined operation conditions established by a system administrator or the user. In one embodiment, once the user has identified the desired access point, movement toward the access point correspondingly improves reception of the Bluetooth signal.

In another embodiment, the door identified to the user as having the highest signal strength is automatically opened or unlocked, depending on operation conditions established at the server 102 or in the application 113. For instance, the electronic lock 106 receives an identifying credential from the mobile device 104 which is compared to a predetermined list of users which have been granted access privileges. If the user determines that the identified door is not one which is preferred, the application 113 displays on the user interface 132 an override feature which prevents the automatic unlocking or automatic opening of the door. The door is therefore opened without any user interaction required. The ultrasonic technology also enables the access control system 100 to detect if the user has already passed a door and/or whether the user is inside or outside of a door or room.

It is also contemplated that, in some embodiments, the mobile device 104 may automatically determine which reader/lock 106 to unlock with the user making a selection. The mobile device 104 may make this determination based on the ultrasonic signal, the Bluetooth signal, and/or other sensor inputs. Furthermore, it is contemplated that the mobile device 104 may perform these analyses and actions in the background without displaying them on a user interface of the mobile device 104.

Figure 4:
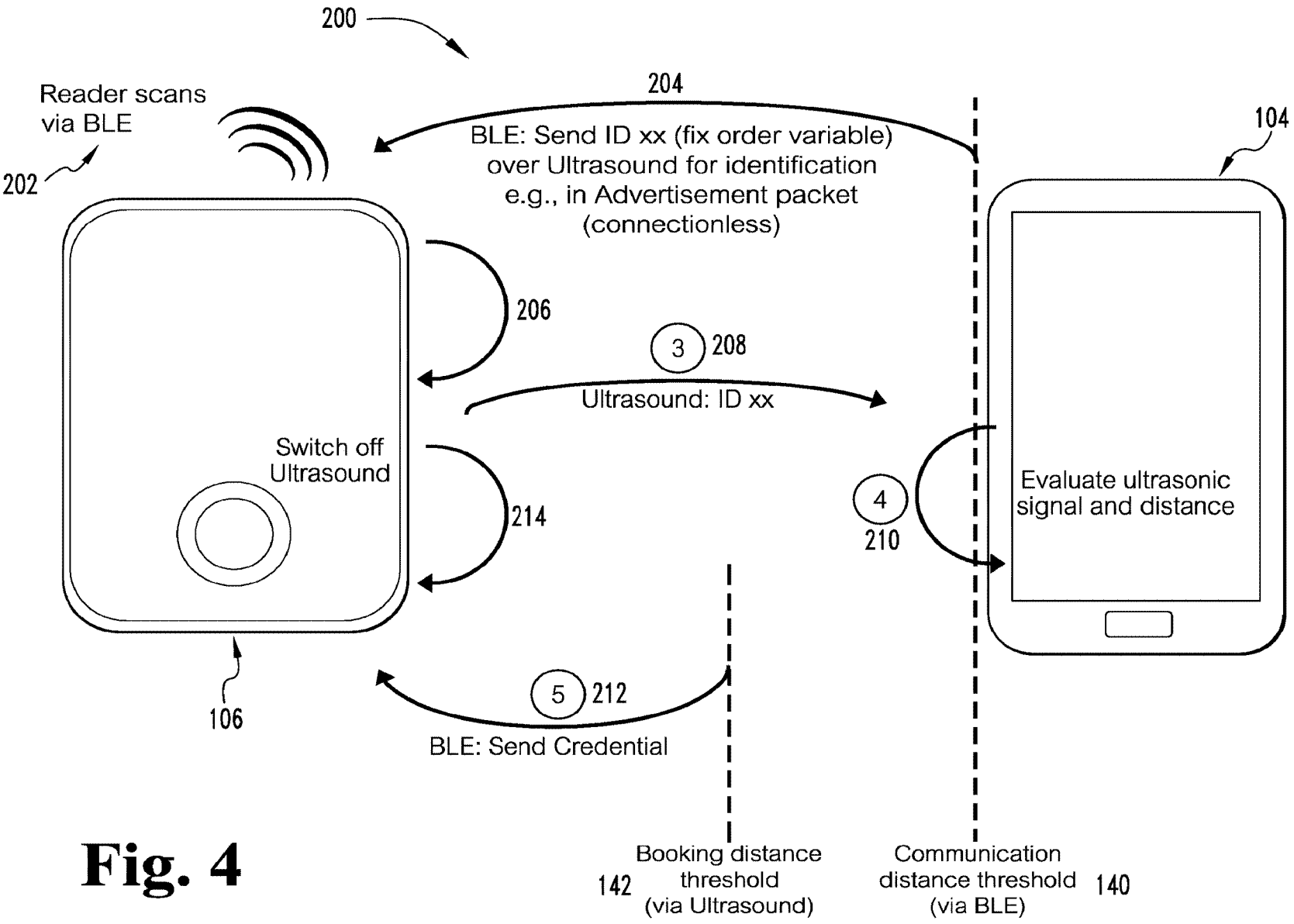
FIG. 4 is a schematic block diagram illustrating an exemplary process flow.

FIG. 4 illustrates a schematic flow diagram of an exemplary process 200 for a mobile device 104 to communicate with the reader device 106. Operations illustrated for all of the processes are understood to be exemplary only, and operations may be combined or divided, and added or removed, as well as re-ordered in whole or in part, unless explicitly stated to the contrary.

Process 200 begins at operation 202 in which the reader device 106 scans via BLE for a communication from the mobile device 104. The reader device 106 may transmit an advertisement packet, or the reader device 106 may be scanning for an advertisement packet from the mobile device 104.

Process 200 then proceeds from operation 202 to operation 204 in which the mobile device 104 transmits a Bluetooth packet to the reader device 106. The Bluetooth packet may be an advertisement packet (e.g., connectionless), or a response to an advertisement packet from the reader device 106. The Bluetooth packet from the mobile device 104 may also include an identifier (e.g., fix order variable) or other information that the reader device 106 may use as an identifier or to generate an identifier for the ultrasonic signal. The communication distance threshold 140 illustrates that the reader device 106 and the mobile device 104 may communicate at a greater distance over Bluetooth than over ultrasonic.

Process 200 then proceeds from operation 204 to operation 206 in which the reader device 106 turns on or activates its ultrasonic transmitter or transducer. The reader device 106 also determines or generates an identifier to include in the ultrasonic signal based on the identifier or information received from the mobile device 104 via Bluetooth. The identifier may be a particular modulation pattern of the ultrasonic signal.

Process 200 then proceeds from operation 206 to operation 208 in which the reader device 106 transmits the identifier via the ultrasonic transmitter or transducer. The reader device 106 may begin transmitting over ultrasonic once the mobile device is at the communication distance threshold 140, or at some point in closer proximity to the reader device 104 based on the signal strength of the mobile device 104. It is contemplated that the reader device 106 may continue to transmit the ultrasonic signal while the mobile device is within the communication distance threshold 140 or until some other event, as described in further detail below.

Process 200 then proceeds from operation 208 to operation 210 in which the mobile device 104 receives the ultrasonic signal(s). The mobile device 104 evaluates the ultrasonic signal(s) to determine a proximity or distance between the mobile device and the reader device 106.

Process 200 then proceeds from operation 210 to operation 212 in which the mobile device 104 determines that the mobile device 104 is within a booking distance threshold 142. Once the mobile device 104 is within the booking distance threshold, the mobile device 104 transmits a credential to the reader device 106. The booking distance threshold 142 represents a proximity or distance in which the mobile device 104 has determined that the user wishes to access the area secured by the reader device 106 and is relatively close to the reader device 106.

Process 200 then proceeds from operation 212 to operation 214 in which the reader device 106 receives the credential from the mobile device 104 and uses the credential to determine whether to the grant the mobile device 104 access to the secure area. It is contemplated that, in some embodiments, the user may need to provide an express form of intent such as pressing/selecting an item or button on a mobile device, or press a button mounted on or near a door, before the reader device 106 unlocks. The reader device 106 may then turn off the ultrasonic transmitter or transducer after the reader device 106 receives the credential from the mobile device 104.

Figure 5:
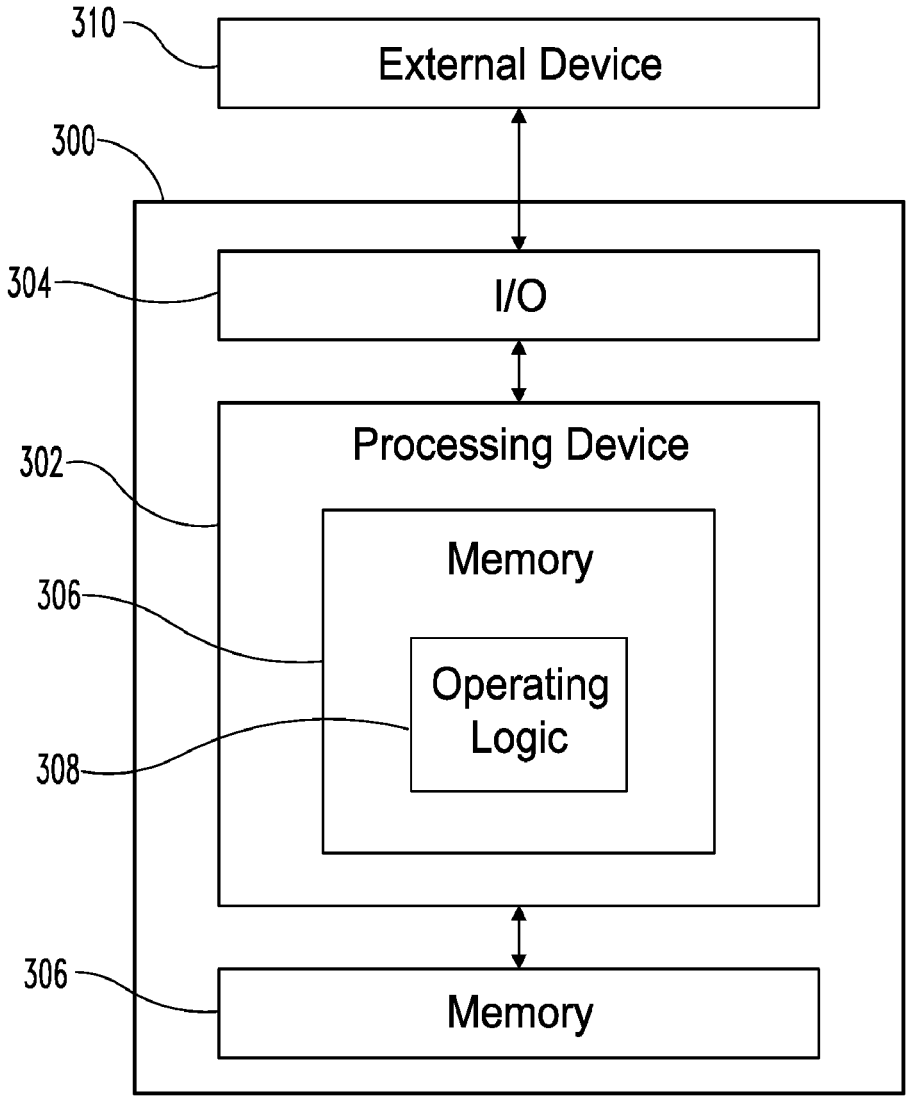
FIG. 5 is a schematic block diagram of an exemplary computing device.

FIG. 5 is a schematic block diagram of an exemplary computing device 300. The computing device 300 is one example of a server, a mobile device, a reader device and/or a wireless device configuration that may be utilized in connection with the server 102, the mobile device 104, and/or the reader/lock device 106 shown in FIG. 1. In the illustrated embodiment, the computing device 300 includes a processing device 302, an input/output device 304, memory 306, and operating logic 308. Furthermore, the computing device 300 may communicate with one or more external devices 310.

The input/output device 304 allows the computing device 300 to communicate with the external device 310. For example, the input/output device 304 may be a transceiver, a network adapter, a network card, an interface, or a communication port (e.g., a USB port, serial port, parallel port, an analog port, a digital port, VGA, DVI, HDMI, FireWire, CAT 5, or any other type of communication port or interface). The input/output device 304 may include hardware, software, and/or firmware. It is also contemplated that the input/output device 304 may include more than one of these adapters, cards or ports.

The external device 310 may be configured as any type of device that allows data to be inputted or outputted from the computing device 300. For example, the external device 310 may be a mobile device, a reader device, other electronic equipment, a handheld computer, a diagnostic tool, a controller, a computer, a server, a processing system, a printer, a display, an alarm, an illuminated indicator such as a status indicator, a keyboard, a mouse, or a touch screen display. Furthermore, it is contemplated that the external device 310 may be integrated into the computing device 300. It is further contemplated that there may be more than one external device in communication with the computing device 300.

The processing device 302 can be a programmable type, a dedicated hardwired state machine, or any combination thereof. The processing device 302 may further include multiple processors, Arithmetic-Logic Units (ALUs), Central Processing Units (CPUs), Digital Signal Processors (DSPs), or the like. Processing devices 302 with multiple processing units may utilize distributed, pipelined, and/or parallel processing. The processing device 302 may be dedicated to the performance of just the operations described herein, or may be utilized in one or more additional applications. In the depicted form, the processing device 302 is of a programmable variety that executes algorithms and processes data in accordance with operating logic 308, as defined by programming instructions (such as software or firmware) stored in memory 306. Alternatively or additionally, the operating logic 308 for the processing device 302 is at least partially defined by hardwired logic or other hardware. The processing device 302 may include one or more components of any type suitable to process the signals received from the input/output device 304 or elsewhere, and to provide desired output signals. Such components may include digital circuitry, analog circuitry, or a combination of both.

In different embodiments, memory 306 is of one or more types, such as a solid-state variety, electromagnetic variety, optical variety, or any combination thereof. Furthermore, memory 306 can be volatile, nonvolatile, or a combination of these types, and some or all of memory 306 can be of a portable variety, such as a disk, tape, memory stick, cartridge, or the like. Additionally, memory 306 can store data that is manipulated by the operating logic 308 of the processing device 302, such as data representative of signals received from and/or sent to input/output device 304, in addition to or in lieu of storing programming instructions defining the operating logic 308, just to name one example. As shown in FIG. 5, memory 306 may be included with the processing device 302 and/or coupled to the processing device 302.

The various aspects the embodiments of the present disclosure, in different embodiments, are implemented in the operating logic 308 as operations by software, hardware, artificial intelligence, fuzzy logic, or any combination thereof, or at least partially performed by a user or operator. In certain embodiments, operations are defined as software elements of a computer program or computer software. The software includes one or more specific applications, components, programs, objects, modules or sequence of instructions typically referred to as "program code". The program code includes one or more instructions located in memory and other storage devices. The program code is stored on a computer readable medium, wherein the server 102, the mobile device 104, and/or the reader/lock device 106 perform the described operations when executing the computer program.

It is also contemplated that the various aspects, features, computing devices, processes, and operations from the various embodiments may be used in any of the other embodiments unless expressly stated to the contrary.

In another embodiment of the present disclosure, a wireless-enabled credential is provided which utilizes ultrasonic technology for identification and position evaluation.

In another embodiment, ultrasonic technology is used as an additional data channel to identify a credential reader to a mobile device having a mobile credential. In a further embodiment, the wireless-enabled mobile device including ultrasonic recognition is configured to determine a position of the user with respect to a credential reader.

In an additional embodiment, an electronic lock system is provided which includes a credential configured to be stored on a mobile device, and also includes an electronic lock. The electronic lock is configured to wirelessly communicate with the mobile device. The electronic lock includes a wireless transceiver and an ultrasonic transmitter, wherein the ultrasonic transmitter is configured to generate a lock identifier configured to be received and identified by the application of the mobile device, and wherein the wireless transceiver is configured to receive an identifying credential from the mobile device to determine access to a door at which the electronic lock is located.

In a further embodiment, a method of operating an electronic lock system is provided including an access control device and a user credential stored on a mobile device. In one embodiment, the method includes transmitting an access control device identifier with an ultrasonic transmitter, receiving, with a wireless device, an identifying credential received from the mobile device responding to the transmitted identifier, and determining whether the received identifying credential authorizes the mobile device to change a status of the access control device.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An access control system, comprising:

a mobile device including a microphone and a credential; and an access control device configured to wirelessly communicate with the mobile device, the access control device including a wireless transceiver and an ultrasonic transmitter;

wherein the access control device is configured to generate an access control device identifier that is transmitted by the ultrasonic transmitter and received by the microphone of the mobile device;

wherein the mobile device is configured to evaluate the access control device identifier to determine a proximity of the mobile device relative to the reader device; and wherein the wireless transceiver of the access control device is configured to receive the credential from the mobile device.

2. The access control system of claim 1, wherein the access control device comprises an electronic lock configured to unlock when the credential received by the electronic lock is determined to correspond to a user having an access privilege.

3. The access control system of claim 1, wherein the mobile device is further configured to determine if there is a spatial separation between the mobile device and the access control device based on evaluation of the access control device identifier by the mobile device.

4. The access control system of claim 1, wherein the access control device is a reader, and wherein the reader is configured to send the credential received by the access control system to an access control panel configured to determine whether to grant access to the mobile device.

5. The access control system of claim 1, wherein the access control device identifier is a modulated ultrasonic signal.

6. The access control system of claim 1, wherein the mobile device receives the credential from a server via a wireless connection.

7. The access control system of claim 1, wherein the mobile device is configured to send the access control device identifier wirelessly to the wireless transceiver of the access control device.

8. The access control system of claim 1, wherein the mobile device is configured to transmit the credential to the access control device automatically when the mobile device determines that a user of the mobile device intends to open a door associated with the access control device based on the evaluation of the access control device identifier.

9. The access control system of claim 1, wherein the wireless transceiver is one of a Bluetooth transceiver and a WiFi transceiver.

10. A method of operating an access control system including an access control device and a user credential stored on a mobile device, the method comprising:

ultrasonically transmitting an access control device identifier;

receiving, with a wireless device of the access control device, a credential from the mobile device in response to the transmitted access control device identifier; and determining whether the received identifying credential authorizes the mobile device to unlock a lock associated with the access control device.

11. The method of claim 10, wherein the mobile device sets the access control device identifier transmitted by the access control device.

12. The method of claim 10, wherein the mobile device is a smartphone.

13. The method of claim 10, wherein the ultrasonically transmitting includes transmitting the access control device identifier at a frequency within an operable range of a microphone of the mobile device.

14. The method of claim 13, wherein the frequency is at or above 20 kHz.

15. The method of claim 14, wherein the wireless device is one of a Bluetooth transceiver and a WiFi transceiver.

16. A method of operating an access control system including a user credential stored on a mobile device and a plurality of electronic locks each configured to control access to at least one door, the method comprising:

ultrasonically transmitting from each of the plurality of electronic locks a lock identifier;

receiving, with a wireless device, an identifying credential from at one of the plurality of electronic locks, the identifying credential received from the mobile device responding to one of the plurality of transmitted lock identifiers; and determining whether the received identifying credential authorizes the mobile device to unlock the one of the plurality of electronic locks.

17. The method of claim 16, wherein the wireless device is a one of a Bluetooth and a WiFi transceiver.

18. The method of claim 16, wherein the mobile device is configured to determine a proximity between the mobile device and at least one of the electronic locks based on an evaluation of the lock identifier.

19. The method of claim 16, wherein the ultrasonically transmitting includes transmitting the lock identifier with at a frequency compatible with a microphone of the mobile device, and wherein the frequency is at or above 20 kHz.

20. The method of claim 16, wherein the mobile device sets the lock identifier transmitted by the access control device.

* * * * *